United States Patent [19]

McGehee

[11] 4,143,874

[45] Mar. 13, 1979

[54] FOUL LINE DETECTOR CIRCUIT

[76] Inventor: Richard S. McGehee, 1509 Crawford La., Hanover Park, Ill. 60103

[21] Appl. No.: 827,172

[22] Filed: Aug. 24, 1977

[51] Int. Cl.[2] ..... A63D 5/04

[52] U.S. Cl. ..... 273/50

[58] Field of Search ..... 250/206, 221, 222; 273/29 R, 31, 50, 101.1, 102.2 R, 102.2 B; 340/323 R, 190, 201 R, 201 P, 258 B

[56] References Cited

U.S. PATENT DOCUMENTS

| | | | |
|---|---|---|---|
| 3,170,689 | 2/1965 | Brown et al. | 273/50 |
| 3,743,290 | 7/1973 | Crimmins et al. | 273/50 |
| 3,810,148 | 5/1974 | Karsten et al. | 273/50 X |
| 3,931,514 | 1/1976 | Patterson | 250/206 |
| 3,949,233 | 4/1976 | Gluck | 250/206 |
| 3,967,111 | 6/1976 | Brown | 250/222 R X |
| 3,982,759 | 9/1976 | Grant | 273/31 |
| 4,028,690 | 6/1977 | Buckley et al. | 340/258 B |

*Primary Examiner*—Vance Y. Hum

*Attorney, Agent, or Firm*—Lester N. Arnold

[57] ABSTRACT

A light sensitive photocell activated foul line detector circuit utilized in the sport of bowling employs an integrated circuit IC to activate a silicone controlled rectifier SCR operating as a gated device to trigger a connected light indicator device or audible alarm device. A pair of transistors are employed with dual light channel photocell device to selectively activate a common buzzer channel circuit portion together with the activated one of the dual light channel photocell device.

4 Claims, 3 Drawing Figures

FOUL LINE DETECTOR CIRCUIT

BACKGROUND

This invention relates generally to detector circuit systems utilized for detecting foul line infractions during a game of bowling, and more particularly, to an improved foul line detector circuit employing an integrated circuit IC to activate a silicone controlled rectifier SCR which in turn selectively activates an indicator light and/or a buzzer device.

Foul line detectors are commonly employed in the game of bowling to detect, as by means of the interruption of a photoelectric light beam, the protrusion of a bowler's foot or leg across a foul line during the release of a bowler's toss. Foul line detectors have found application for timer circuits as well which are used to distinguish transient interruptions, such as ball passage, which should not result in a foul detection. One earlier disclosed detector system as described in U.S. Pat. No. 3,083,966, issued Apr. 2, 1963, to M. E. Untiedt, employed a photocell actuated by a suitable light source. The resistance thereof increases and current flow to a solenoid is dropped to deenergizing level. A shunting capacitor is used to maintain sufficient current to the solenoid for a given time delay to provide for noninterruption by transient conditions. Another foul detector is described in U.S. Pat. No. 3,170,689, issued Feb. 23, 1965, to Raymond E. Brown et al., wherein the foul detecting circuit is purely electronic solid state components and devices, to improve over previous detector circuits including mechanically-operating devices.

Another patented detector system is disclosed in U.S. Pat. No. 3,743,290, issued to Wlm. M. Crimmins et al. on July 3, 1973, wherein the control circuit included timer circuits with programmed unijunction transistors and electronic flip-flop circuits controlling SCR switching elements and triac switching elements.

SUMMARY

The foul line detector circuit of the present invention is particularly designed to operate within prior art one-piece housings as have twin reflective light paths for activating twin photocells. The present invention comprises a single integrated circuit IC per light channel (beam) and has a single silicone controlled rectifier SCR per channel which becomes activated when the IC is made active through the decrease of the IC threshold trigger voltage due to increase of the photocell resistance. An active SCR state triggers both a red light and a buzzer, which two signals are required by the American Bowling Congress (ABC) for foul line violation signals. The SCR desirably provides a half-wave output for use with indicator light bulbs and audio buzzers.

A foul line detector circuit includes in combination first photocell means responsive to light activation thereof to provide a first resistance state thereof, and is responsive to termination of said light activation to provide a second resistance state thereof; first RC time constant network means is discharged during the second resistance state of said photocell means being responsive to the termination of said light activation; second RC time constant network means is charged for a predetermined time period during the second resistance state of said photocell means when said first RC time constant means has obtained substantially full discharge state thereof; integrated circuit timer means triggered into activation upon said first RC time constant network obtaining substantial full discharge thereof, said integrated circuit timer means providing a predetermined time delay responsive to the predetermined time delay of said second RC time constant means and further providing output signaling upon activation thereof responsive to the full discharge condition of said first RC time constant means, and further providing termination of said output signaling thereof after said predetermined time delay of said second RC time constant means, said first RC time constant means having the full charge thereof connected to cause deactivation of the integrated circuit timer means, which timer means when activated provides charging condition for said second RC time constant means; gated switching means having the gate thereof connected to receive said output signaling from accompanying triggering of the timer means and being responsive thereto to switch to current conduction condition, and responsive to termination of said output signaling to switch to current non-conduction condition; and indicator means is responsive to said current conduction condition of said gated switching means for indicating a foul state resulting from the termination of light activation for time period delays required to provide said substantial discharge of said first RC time constant means.

It is a primary object of the present invention to provide an improved foul line detector circuit utilizing only a single integrated circuit IC and a single SCR to trigger visual/audio alarms; it is another object to provide a more economical circuit which is easily repaired and can be installed as a replacement for previously known and more complicated detector systems with photocell activation which do not make use of integrated circuits; it is still another object of the invention to provide for a guard against false triggering of alarms through provision of a time delay before activation of the IC circuit, as achieved by preceding RC time constant network means.

It is yet another object of the invention to provide for separation between a left and a right photocell system and dual light channel indicator means by through provision of two transistors.

It is a further object of the invention to provide dual foul line detection from a single housing using commonly known twin retro-reflective photoelectric beams.

Other objects and advantages of the present invention over known foul line detectors will become more obvious and apparent as the present invention is described and claimed in connection with the accompanying drawing, to wit:

THE DRAWING

DETAILED DESCRIPTION

Figure 1:
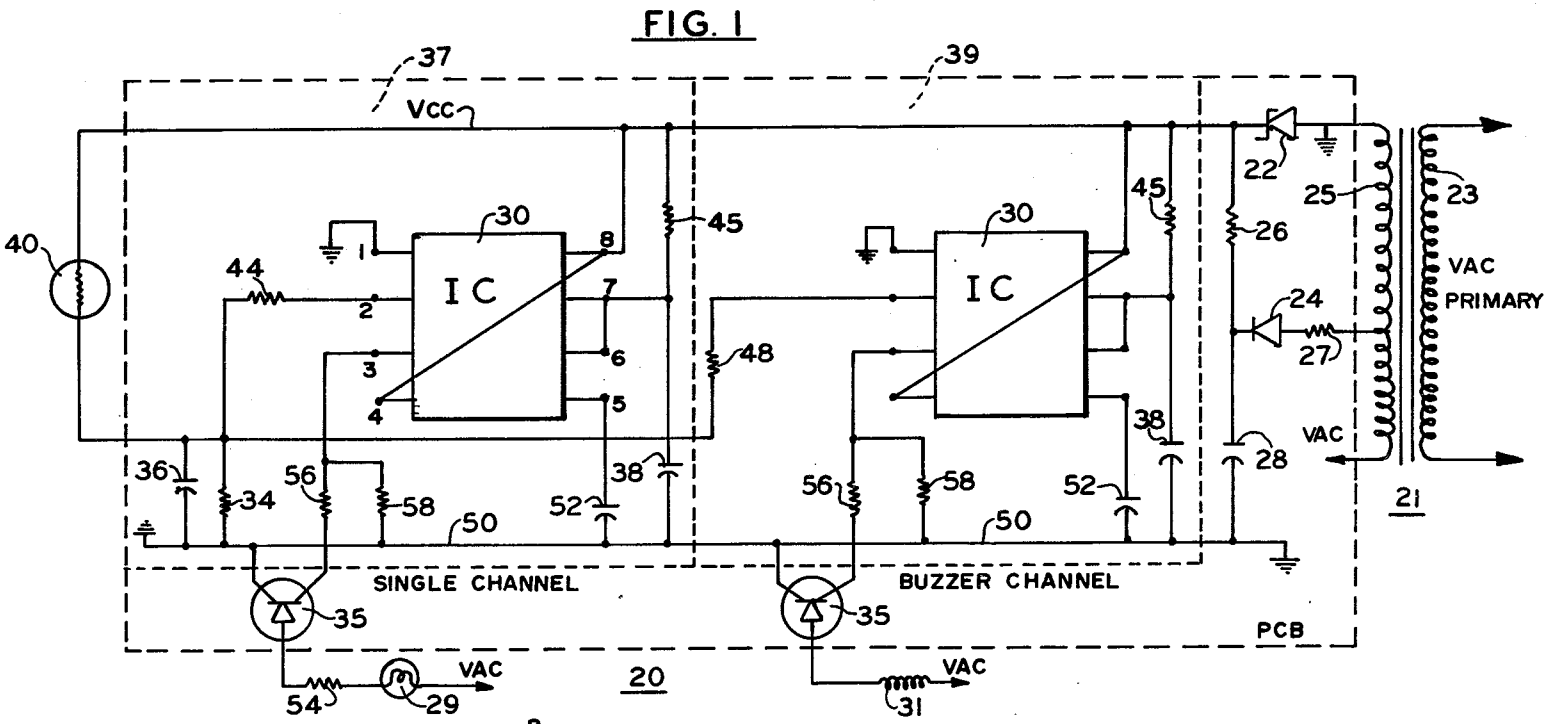
FIG. 1 is a schematic illustration of the foul line detector circuit in accordance with the present invention having a single light channel foul line detection.

FIG. 1 shows a primary embodiment 20 of the foul line detector circuit in accordance with the present invention wherein a power transformer 21 provides suitable power source means and Zener diode means 22, diode means 24, resistor means 26 and 27 and capacitor means 28 jointly comprise rectifier means and filtering means is a commonly employed circuit configuration for these purposes. The power transformer 21 has a primary coil 23 and a center tapped secondary coil 25 which allows one-half secondary voltage to be developed for use in activating a so-called printed circuit-board PCB having as an integral part thereof integrated circuit (IC) means 30 as will be discussed more fully hereinafter.

The full secondary transformer voltage VAC is connected to operate indicator light means 29 and audible buzzer means 31. The operation of the indicator light 29 and buzzer 31 are controlled by the integrated circuit (IC) means 30 and so-called silicone controlled rectifier (SCR) means 35. The integrated circuit means 30 is activated by the variation of the resistance of photocell means 40 which occurs when the continuous activation of the photocell 40 by an aligned beam of light (not shown) is interrupted by a breaking of the light beam. Transient interruptions of the light beam for time periods less than predetermined time periods must be ignored by the foul line detector circuit 20. RC time constant network means comprised of capacitor 34 and resistor 36 provide a predetermined RC time constant for delaying the activation of the IC means 30 during desired transient periods (measurable in seconds). The RC time constant means 34 and 36 comprise a first such RC time constant means which is normally charged to full charge capacity thereof during periods of photocell light activation. The interruption of the light activation causes the resistance of the photocell means 40 to significantly increase, causing the first RC time constant means 34 and 36 to discharge toward substantially full discharge condition. The time period required for the substantial full discharge of the first RC time constant means 34 and 36 is the time period during which the transient interruptions of light activation are ignored (not reacted to) by the foul line detector circuit 20. The output signal of the IC means 30 is directly connected to activate SCR means 35 which in turn is directly connected to selectively activate either one of the indicator light 29 or the buzzer 31.

The circuit embodiment of FIG. 1 discloses a single light channel detector circuit portion as illustrated by the dashed block area marked as 37 and an audible buzzer detector circuit portion marked as 39. Photocell means 40 is connected to the trigger gate (FIG. 3) of IC means 30 of the light channel 37 through resistor means 44, and to the trigger gate of IC means 30 of the buzzer channel 39 through resistor means 48. The resistor means 34 is connected between the ground lead 50 and each of the resistors 44 and 48 to provide suitable voltage divider means for setting and controlling in a conventional manner the trigger voltage of IC means 30. The photocell 40 is activated by a suitable beam of light (not shown in the drawing). As heretofore stated, any interruptions of the light beam result in an increase in the resistance of the photocell 40. The resistance increase of photocell 40 effecting the substantial discharge of the first RC time constant means 34 and 36 has the effect of dropping or lowering the threshold voltage of an associated IC means 30, which IC means 30 when activated promptly provides an output signal to the gate of an associated SCR 35 to permit current conduction through the SCR 35.

Figure 3:
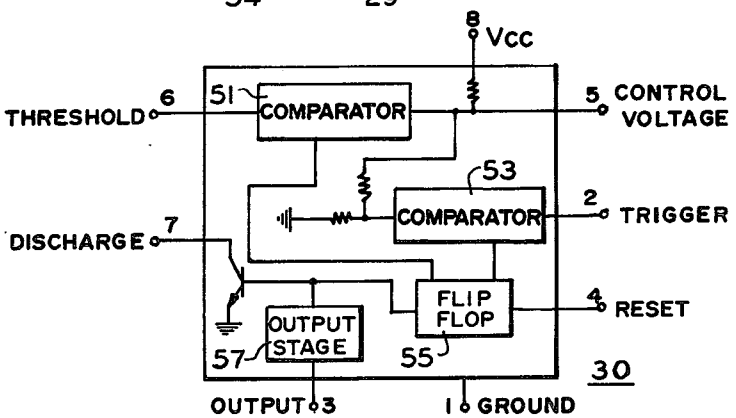
FIG. 3 is a partial schematic and block representation of a selected integrated circuit IC useful with the present invention.

FIG. 3 discloses a partial schematic and partial block representation of an integrated circuit IC which is useful as the IC 30 of the present invention. The IC means 30 is basically a highly stable monolithic timer circuit with an output signal suitably high to trigger an associated SCR device. As shown in FIG. 3, the IC means 30 is comprised of a pair of comparator circuits 51 and 53, a flip-flop circuit 55 and a final driver output state 57. The comparator circuit 51 compares threshold and control voltage, and the comparator 53 compares control voltage and trigger voltage. The IC means 30 is employed in a monostable mode of operation functioning as a so-called one shot switching device. Now referring to both FIGS. 1 and 3, there is provided on the discharge gate 7 of the IC means 30, an external discharge capacitor 38 which is initially held discharged by a transistor (not shown) internal to the IC means 30.

Upon application of a negative trigger pulse to the trigger gate 2, the flip-flop 55 is set which releases the short circuit across the discharge capacitor 38 and drives the output signal on the output gate 3 to the high state. When the voltage across the capacitor 38 equals approximately two-thirds the reference voltage source $V_{CC}$ connected to the supply gate 8, the related comparator 53 resets the flip-flop 55 which in turn discharges the capacitor 38 rapidly to drive the output signal on gate 3 to the low state. In the high output state of the IC 30, the operating SCR 35 conducts current between the reference voltage source VAC and the ground lead 50 either through the light indicator means 29 such as a suitably rated indicator bulb (line resistance being shown at 54) or through the audible alarm means 31 such as a buzzer alarm coil.

The gate lead for each SCR 35 is provided with a parallel arranged resistor divider network comprised of resistor means 56 and 58. As utilized in the present invention, the control voltage (gate 5) of the IC 30 is connected to a suitably rated external capacitor 52, and the gates 4 and 8 can be tied directly to the $V_{CC}$ power source. The gates 6 and 7 of FIG. 3 are interconnected together and to the mid-node of a second RC time constant network means comprised of resistor means 45 and the discharge capacitor means 38. The resistor means 45 is further useful to determine the threshold voltage to the gate 6 of the IC means 30. The capacitor 38 is caused to begin charging upon the activation of the IC means 30, and charges according to the time period predetermined by the values of the resistor 45 and the discharge capacitor 38, that is, according to the RC time constant thereof. As stated heretofore, a typical time delay for the second RC time constant, that is, the length of time for the IC means 30 to conduct and activate the associated SCR 35, would be approximately fourteen (14) seconds. A typical IC circuit which can be employed as the IC means 30 of the present invention is an Archer Pak 276-1614 IC timer as manufactured for Tandy Corporation and which is connected to operate in a monostable switching mode.

The single light channel circuit embodiment 20 of FIG. 1 therefore provides that the single channel circuit portion 37 and the buzzer channel circuit portion 39 is mutually powered by the transformer source 21, and is mutually connecting the photocell 40 to the trigger gate 2 of the respective IC means 30 thereof. The filtering and rectifying configuration of the Zener diode 22, the diode 24, capacitor 28 are thought to be conventional and hence no detailed explanation thereof is given herein. The ground gate 1 of the IC means 30 of the light channel portion 37 is suitably grounded. The trigger gate 2 thereof is connected through the bias resistor 44 to the photocell 40. The output gate 3 thereof is connected directly to the gate lead of the associated SCR 35 through the parallel arranged resistor divider-network 56 and 58. The RC time constant network 36 and 34 is connected between the photocell 40 and the trigger gate 2 of the IC means 30. The reset gate 4 and the power source gate 8 are commonly connected to the power lead $V_{CC}$. The threshold gate 6 is tied to the power lead $V_{CC}$ through the bias resistor 45; the discharge gate 7 is tied to the threshold gate 6 and to the discharge capacitor 38. The control voltage gate 5 is connected to the capacitor 52 for setting control voltage to the IC means 30. The conduction of the IC 30 is directly functional to trigger the conduction of the SCR 35 which completes a current path from VAC to light indicator 29 on through the SCR 35 to ground. The buzzer channel 39 is similarly connected for identical operation.

Typical circuit types and values for the circuit embodiment of FIG. 1 is as follows: 1.5 ohms resistance for photocell 40 with light activation, and 1 megaohm resistance with no light activation; 2 microfarads-capacitor 36; 15 Kohms-resistor 34; 1 megaohm-resistor 44; 1 Kohm-resistor 56; 4.7 K ohm-resistor 58; 0.01 microfarad-capacitor 52; 0.68 microfarad-capacitor 38; and 15 megaohm-resistor 45. The RC time constant of capacitor 36 and resistor 34 is approximately 4 to 8 seconds to prevent false triggering. The RC time constant of capacitor 38 and resistor 45 is approximately 14 seconds to turn off (deactivate) the IC means 30. As explained hereinbefore, the circuit IC 30 triggers on a negative going output signal when the trigger voltage level reaches approximately one-third ($\frac{1}{3}$) $V_{CC}$. Once triggered, the circuit IC 30 will remain activated until the set time of the RC time constant of capacitor 38 and resistor 45 is elapsed, even if the circuit IC 30 is again triggered during this time constant interval.

Figure 2:
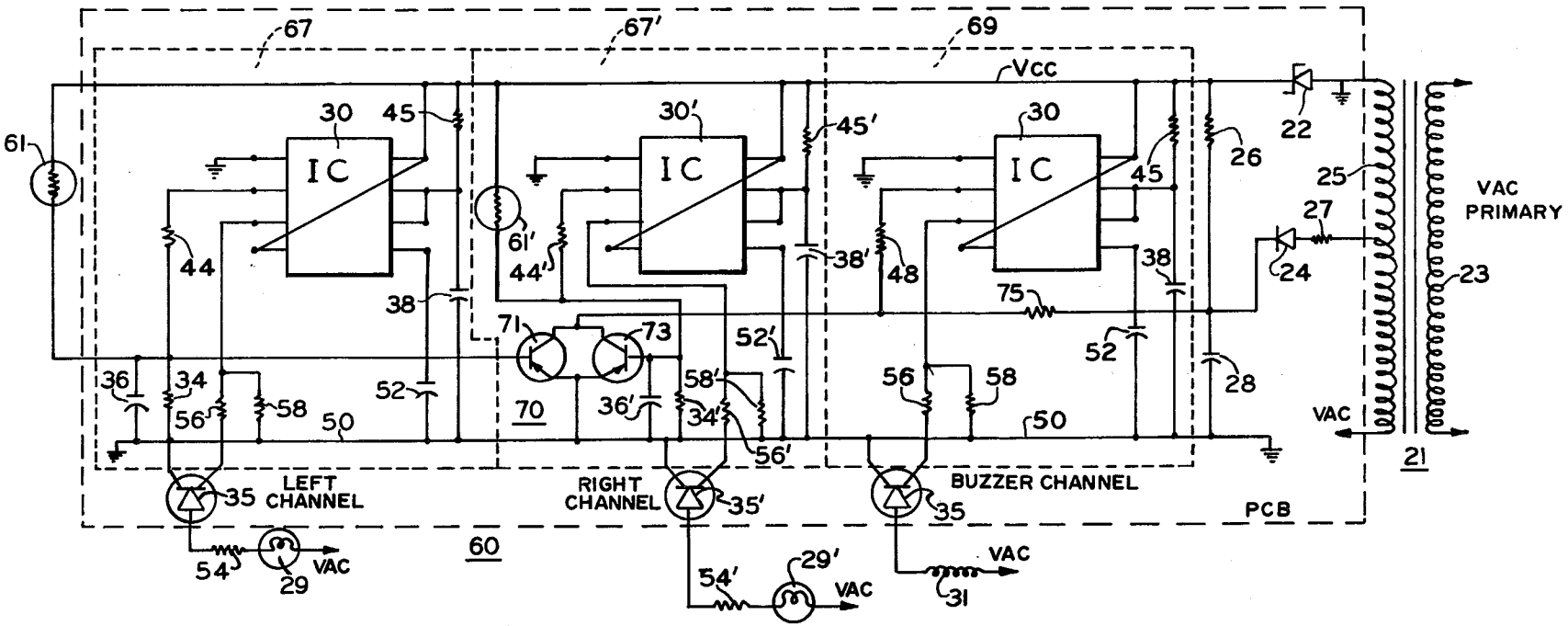
FIG. 2 is another schematic illustration of the foul line detector circuit of the present invention having dual light channel foul line detection.

FIG. 2 discloses another embodiment 60 of the foul line detector circuit employing a dual light channel conveniently referred to herein as left light channel and right light channel detector circuit portions and marked as 67 and 67′ within dashed lines, respectively. Single photocells 61 and 61′ are employed with the left and right channel detector circuit portions, respectively. The left and right channel portions 67 and 67′ are repetitive to the single channel configuration 37 shown in FIG. 1, as is the buzzer channel 69 of FIG. 2 repetitive to the buzzer channel configuration 39 of FIG. 1. Hence, the circuit components and elements of FIG. 2, which are substantially identical with those elements discussed in connection with the disclosure of the detector circuit embodiment 20 of FIG. 1, will be shown in FIG. 2 as having the same reference numerals when the same are identical with that shown for FIG. 1 in reference to the left channel 67 and are given prime reference numerals for the identical elements thereof in reference to the right channel 67 for purposes of clarity and brevity herein. The left and right channel circuit portions 67 and 67′ are operatively isolated from each other by the provision of a transistor network or means 70 comprised of left-most transistor means 71 and right-most transistor means 73, (having reference to the position of the transistors in FIG. 2). The purpose of the transistor network 70 is to isolate the left and right channel portions 67 and 67′ so that each thereof can function independently in cooperation with the buzzer channel portion 69, thereby obviating any necessity to duplicate the buzzer channel portion 69. The outermost dashed lines of both FIGS. 1 and 2 are identified as PCB for indicating that all shown therein could desirably be provided on a single printed circuit board to be connected to a proper center-taped secondary coil of a transformer power source such as the power transformer 21.

The transistor devices 71 and 73 are PNP type transistors having the corresponding collector nodes thereof and the corresponding emitter nodes thereof interconnected, respectively, with the interconnected emitters tied to the common ground lead 50. The base of the transistor 71 is tied to the output of the photocell 61 of the left channel circuit portion 67, and is caused to conduct relatively simultaneously to the triggering of the associated IC means 30. The collector thereof is interconnected to the IC means 30 of the buzzer channel 69, and through suitable resistor means 75 to the center tap of the secondary transformer coil 25.

The conduction of the transistor 71 is effective to cause the triggering of the IC means 30 of the buzzer channel 69 and therefore the energization of the buzzer element 31 simultaneously with the accompanying operation of the light indicator bulb 29 for the left channel 67. Furthermore, the collector lead of the transistor 73 is shown in FIG. 2 to be interconnected to the IC means 30 of the buzzer channel 69, and to have the base lead thereof connected to the output lead of the photocell 61′ together with the input trigger gate of the IC means 30′ of the right channel circuit portion 67′. The interruption of the beam activation to the photocell 61′ for longer than the maximum allowed transient period as determined by the first RC time constant network 34′ and 36′ will result in the relative simultaneous conduction of the IC means 30′ and the associated transistor 73. The operation of the IC means 30′ triggers the associated silicone controlled rectifier SCR 35′ to activate the associated light indicator bulb 29′ for the right channel 67′. It is to be understood that the operation (conduction) of the transistors 71 and 73 are completely independent of each other so that the circuit channel portions 67 and 67′ can independently handle interruptions of the respectively aligned light beams for a dual light beam foul line detector device.

In FIG. 2, the $V_{AC}$ primary 23 and the $V_{AC}$ secondary 25 of the transformer source means 21 provide suitable power source means for the foul line detector circuit 60. The full secondary voltage $V_{AC}$ is applied to the light indicator means 29 and 29′ and the buzzer coil means 31. The voltage source $V_{CC}$ is developed from the secondary coil 25 as explained in connection with FIG. 1. The circuit portions 67 and 67′ are shown to have identical circuit components with the single channel circuit portion 37; the circuit portion 69 is also duplicative of corresponding circuit portion 39 of FIG. 1. The values of typical components are as given heretofore in connection with the disclosure of FIG. 1, but should be understood to be exemplary only as it is well within the skill of the art to select other equally suitable values therefor.

In summary, the foul line detector circuit 60 of FIG. 2 comprises light sensitive variable resistance means 61 and 61′ providing a first resistance state thereof during light activation condition and a second resistance state thereof during termination of said light activation condition; first RC time constant network means 34 and 36 and/or 34′ and 36′ responsive to said light activation condition to accumulate an electric charge, and being responsive to the termination of said light activation condition to discharge said accumulated electric charge, the time period which is elapsed during the discharge thereof comprises a transient time delay period; integrated circuit timer means IC 30 and IC 30' triggered into an active timer state thereof upon the substantial discharge of said first RC time constant means 34 and 36 and/or 34' and 36', said timer means IC 30 and IC 30' providing a predetermined time delay period (14 seconds) and further providing output signaling therefrom (gate 3) responsive to said active state thereof during said predetermined time delay period, second RC time constant network means 38 and 45 and/or 38' and 45' connected to be charged by said timer means IC 30 and IC 30' during activation thereof and effective upon obtaining a predetermined charge thereof to deactivate said timer means IC 30 and IC 30', the time delay period elapsed during the charge of said second RC time constant means 38 and 45 and/or 38' and 45' comprising said predetermined time delay (14 seconds) of said timer means IC 30 and IC 30'; gated silicone controlled rectifier means SCR 35 and SCR 35' activated by the connection of said output signaling to the gate thereof and being deactivated upon the deactivation of said timer means IC 30 and IC 30'; and indicator means 29, 29' and 31 responsive to the activation of the gated rectifier means 35 and 35' to selectively provide the indication of a foul responsive to termination of said light activation for time periods permitting the substantial discharge of said first RC time constant means 34 and 36 and/or 34' and 36'.

It is to be understood that while the present invention has been shown and described with respect to a preferred embodiment thereof, the scope thereof is not intended to be so limited and other equally suitable and equivalent modifications, configurations and changes may be made therein without departing from the spirit and scope thereof.

What is claimed is:

1. A foul line detector circuit for use in detecting foul line interruptions of a beamed light source including in combination electric power source means, light sensitive photocell means connected across the power source means and being normally activated during exposure to the beamed light source and being deactivated during interruptions of the exposure thereto, first RC time constant network means connected to the photocell means and being normally charged by said power source means, said first RC time constant network means being discharged with the deactivation of the photocell means to equal a first predetermined value of electric charge with light source interruptions of a preselected time period, second RC time constant network means being normally discharged, integrated circuit timer means connected to the first RC time constant network means and including means for sensing the discharge thereof, means for triggering activation of the integrated circuit timer means upon the first RC time constant means obtaining said first predetermined value of electric charge, means for providing an output signal, means for sensing the charge of the second RC time constant means, and means for triggering the deactivation of the integrated circuit timer means upon the second RC timer constant means obtaining a first predetermined value of electric charge, said second RC time constant means being connected to the integrated circuit timer means and caused to charge upon activation thereof, said integrated circuit timer means being activated for the time period required to charge the second RC time constant means to the first predetermined value of electric charge, gated switching means having the gate thereof connected to receive said output signaling from the integrated circuit timer means and being activated thereby and further being deactivated with the termination of the output signaling, and indicator means responsive to said activation of the gated switching means for indicating a foul state resulting from the interruption of the light source for time periods equal to the preselected time period.

2. A foul line detector circuit as claimed in claim 1 wherein said timer means comprises a highly stable monolithic circuit interconnected to operate in a monostable mode of operation.

3. A foul line detector circuit as claimed in claim 1 wherein the first predetermined value of charge of the first RC time constant means is relatively low in comparison to the normally charged value thereof, being approximately equal to full discharge thereof.

4. A foul line detector circuit for use with light source means including in combination light sensitive variable resistance means providing a first resistance state thereof during light exposure and a second resistance state thereof during interruption of said light exposure, first RC time constant network means connected to the variable resistance means and being responsive to the first resistance state to charge and to the second resistance state to discharge, the time period elapsed during the discharge thereof to a predetermined value of charge comprising a first time delay, integrated circuit timer means having means for sensing the discharge of the first RC time constant means, means for triggering activation of the integrated circuit timer means after the first time delay occurs, means for providing an output signal during activation thereof, second RC time constant network means connected to receive the output signal of the integrated circuit timer means and to accumulate a charge in response thereto, the time period elapsed during the charge thereof to another predetermined value of charge comprising a second time delay, said integrated circuit timer means further having means for sensing the charge of the second RC time constant means and means for triggering deactivation of the integrated circuit means after the second time delay occurs, switching means activated by the output signal of the integrated circuit timer means, and indicator means activated with activation of the switching means to indicate interruption of the light source means for a time period at least equal to the first time delay period.

* * * * *